US009327492B2

(12) United States Patent
Knott et al.

(10) Patent No.: US 9,327,492 B2
(45) Date of Patent: May 3, 2016

(54) PRINTING MACHINE WITH PRINT HEAD CONTROL

(71) Applicant: KRONES AG, Neutraubling (DE)

(72) Inventors: Josef Knott, Schierling (DE); Hartmut Davidson, Zeitlarn (DE); Andreas Kraus, Lappersdorf (DE); Andreas Sonnauer, Wörth (DE); August Peutl, Wörth/Donau (DE); Viktor Gette, Obertraubling (DE)

(73) Assignee: KRONES AG, Neutraubling (DE)

( * ) Notice: Subject to any disclaimer, the term of this patent is extended or adjusted under 35 U.S.C. 154(b) by 0 days.

(21) Appl. No.: 14/309,310

(22) Filed: Jun. 19, 2014

(65) Prior Publication Data

US 2015/0033965 A1 Feb. 5, 2015

(30) Foreign Application Priority Data

Jul. 31, 2013 (DE) ..... 10 2013 214 980

(51) Int. Cl.
*B41F 17/00* (2006.01)
*B41J 3/407* (2006.01)

(52) U.S. Cl.
CPC ..... *B41F 17/00* (2013.01); *B41J 3/4073* (2013.01)

(58) Field of Classification Search
CPC ..... B41J 3/4073; B41J 3/543; B41J 17/00; B41J 17/28
USPC ..... 101/36
See application file for complete search history.

(56) References Cited

U.S. PATENT DOCUMENTS

| | | | | |
|---|---|---|---|---|
| 5,144,330 | A * | 9/1992 | Bennett | 347/2 |
| 6,360,656 | B2 * | 3/2002 | Kubo | B41F 17/24 101/35 |
| 2010/0053264 | A1 * | 3/2010 | Cho | B41J 2/15 347/40 |
| 2010/0192517 | A1 * | 8/2010 | Schach | B41J 2/0057 53/411 |
| 2010/0279081 | A1 * | 11/2010 | Koele | B41J 2/2132 428/195.1 |
| 2011/0285768 | A1 * | 11/2011 | Preckel | 347/6 |
| 2012/0188299 | A1 * | 7/2012 | Seki | B41J 3/4073 347/9 |
| 2012/0199021 | A1 * | 8/2012 | Till | 101/36 |
| 2013/0257984 | A1 * | 10/2013 | Beier et al. | 347/37 |

FOREIGN PATENT DOCUMENTS

| | | | |
|---|---|---|---|
| CN | 102596579 | A | 7/2012 |
| DE | 102009033810 | A1 | 1/2011 |

(Continued)

OTHER PUBLICATIONS

Search Report for DE 10 2013 214 980.8, dated Mar. 27, 2014.

(Continued)

*Primary Examiner* — Anthony Nguyen
(74) *Attorney, Agent, or Firm* — Marshall, Gerstein & Borun LLP

(57) ABSTRACT

A printing machine for printing onto containers, such as bottles, having at least a conveyor and a printing unit with a print head module, with at least one print head, a movement system for adjusting the position of the print head module, a measuring system for determining the position of the print head module and a control unit for controlling the movement system, where the movement system comprises a radial module for adjusting the position of the print head module in the radial direction and a height module for adjusting the height of the print head module in the vertical direction.

20 Claims, 4 Drawing Sheets

(56) References Cited

FOREIGN PATENT DOCUMENTS

| | | | |
|---|---|---|---|
| DE | 102009041527 | A1 | 2/2011 |
| DE | 102009020702 | B4 | 9/2011 |
| DE | 102011009393 | A1 | 7/2012 |
| DE | 102011009395 | A1 | 7/2012 |
| DE | 102012005087 | A1 | 10/2012 |
| EP | 1435296 | A1 | 7/2004 |
| EP | 1479524 | A1 | 11/2004 |
| EP | 2644392 | A2 | 10/2013 |
| JP | H05318715 | A | 12/1993 |
| JP | 2001287408 | A | 10/2001 |

OTHER PUBLICATIONS

First Office Action for Chinese Application No. 201410363046.X, dated Sep. 11, 2015.

European Search Report for EP14174073, dated Dec. 22, 2014.

* cited by examiner

PRINTING MACHINE WITH PRINT HEAD CONTROL

CROSS-REFERENCE TO RELATED APPLICATION

The application claims priority of German Application No. 10 2013 214 980.8, filed Jul. 31, 2013. The priority application, DE 10 2013 214 980.8, is hereby incorporated by reference.

FIELD OF THE DISCLOSURE

The disclosure relates to a printing machine with moving print heads for printing onto containers such as bottles.

BACKGROUND

It is known from DE 10 2009 020 702 B4 to orient the container, for example, on a marking relative to the print head. The container is there for precise printing prior to printing oriented relative to the print head according to certain markings printed or applied onto the container.

SUMMARY OF THE DISCLOSURE

It is one aspect of the present disclosure to provide a printing machine that increases printing accuracy in the printing of containers.

The printing machine according to the disclosure includes at least a conveyor and a printing unit with a print head module having at least one print head, a movement system for adjusting the position of the print head module, a measuring system for determining the position of the print head module, and a control unit for controlling the movement system, where the movement system includes a radial module for adjusting the position of the print head module in the radial direction, a height module for adjusting the height of the print head module. This printing machine enables very accurate adjustment of the print head module using the radial module and the height module provided.

Furthermore, a tilting module can be provided for adjusting the tilting of the print head module. The print head module can thereby be aligned in dependency of the surface shaping of the container to be printed.

In one embodiment, the movement system further includes an alignment module for vertical alignment of the nozzle rows of the print head module relative to the direction of transport of the containers to be printed. Should the nozzle rows be slightly tilted relative to the direction of transport of the containers to be printed, then this tilting can be corrected so that uniform resolution of the printed image can be achieved.

In a further embodiment, the radial module, the height module, and the tilting module are adjustable independently of each other. Any misalignment of the print head module can thereby be corrected very accurately.

In addition, the radial module, the height module, and the tilting module each include a motor, preferably a motor-spindle-nut drive. Provision of individual motors for the individual modules presently also enables separate actuation.

In one embodiment, the printing machine includes a printing unit that has a device for centering the printing unit at the printing machine. Should replacement or a quick removal of the printing unit from the printing machine be intended, it can therewith always again be returned to the correct position, thereby reducing the installation effort.

In a further embodiment, the measuring system can measure the position of the print head module with an accuracy of <0.5 mm, preferably of <0.1 mm, particularly preferably of <0.01 mm. Positioning the print head module with very high accuracy is thereby possible, which enables printing onto respective containers likewise with very high accuracy.

In a further embodiment, the printing unit is provided exchangeably.

The control unit can adjust the position of the print head module with an accuracy of 0.5 mm, preferably of 0.1 mm, particularly preferably of 0.01 mm. The positions or the necessary changes in position, respectively, obtained from the data of the measuring system can thereby be performed with the respective accuracy.

Furthermore, the printing unit can via a line be associated to an ink tank connected to it. The entire printing unit can thereby be provided in a modular manner. This means that little or no additional elements for the printing unit must be provided in the printing machine itself, and that replacement is particularly easy.

In a further embodiment, the control unit can adjust the position of the print head module in dependency on the data that can be transmitted from the measuring system to the control unit. Due to the accurate measurement of the position of the print head module by the measuring system, this can result in highly accurate position adjustment of the print head module.

In a further embodiment, the radial module, the height module, and the tilting module include clamps that can fix the radial module, the height module and the tilting module at a position.

In one embodiment, the printing machine has piezo-electric elements that are associated to a print head module and are adapted to align the print head module relative to the container to be printed. The use of piezo-electric elements can, firstly, result in highly accurate positioning and, secondly, effect positioning in real time, i.e. specific positioning for each container to be printed.

Furthermore, a protective position and/or a cleaning position and/or a service position can be provided into which the print head module can be moved. A print head module not being used can therefore be protected from external influences, serviced or cleaned.

Furthermore, the printing machine can include a cleaning unit adapted to clean the print head module while it is in the cleaning position. Cleaning of a print head module to be cleaned can therefore be performed preferably automatically and therefore in a time-saving manner, which can shorten the time until being again in use.

DETAILED DESCRIPTION

Figure 1:
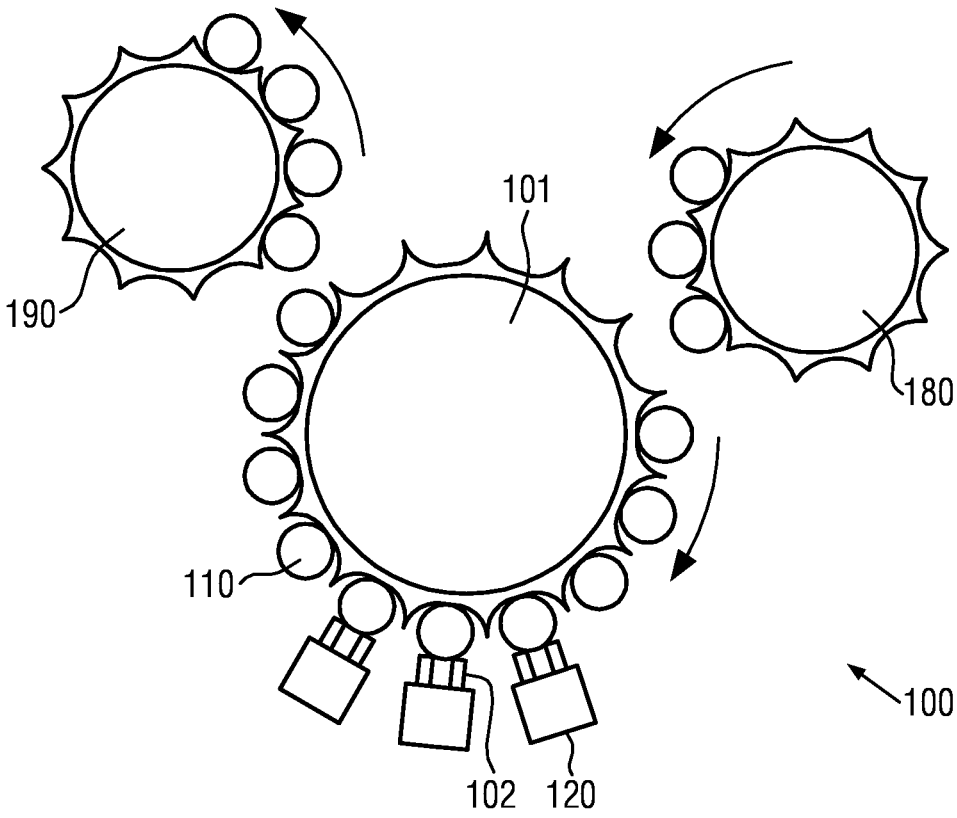
FIG. 1 shows a view of a printing machine according to the disclosure.

FIG. 1 shows a printing machine 100 according to the disclosure in a schematic view. This printing machine 100 includes at least a conveyer 101 with the aid of which the containers, such as bottles 110, can be transported. This conveyor 101 can be any type of conveyor that is commonly used in the container and packaging industry. It can be in particular a linear conveyor or, as presently shown, a conveyor star. It is then, for example, by a further conveyor 180 fed the containers 110 onto which the printing machine 100 is to print. Printing takes place using the printing units 120 comprising at least one print head module 102 while one of the containers 110 is located on the conveyor 101. Depending on the intended printing, for example, uni-colored or patterned or multi-colored, a plurality of printing units 120 can be provided in the printing machine 100. Each of these printing units 120 can also include one or multiple print head modules 102, where the print head modules 102 of a printing unit 120 can print onto the container 110 to be printed using either the same color or with different colors. Furthermore, the individual print head modules 102 of a printing unit 120 can also print onto the container 110 at different locations. Once the printing is completed after passing through all the printing units 120, then the printed container 110 can be removed from the printing machine 100, for example, by a further conveyor 190. This transport can occur both cyclically as well as continuously.

FIG. 2 shows a printing unit 120 with print head modules 102 in relation to a container 110 which can be on a conveyor such as illustrated in FIG. 1. The print head modules are typically positioned as close as possible to the wall of the container in order to ensure correct printing. A printing unit 120 can include either only one print head module 102 or also multiple print head modules 102. They can then, as indicated in FIG. 2, be arranged beneath one another. But it is equally possible to arrange the print head modules 102 adjacent to each other. Each print head module 102 includes at least one print head presently not shown. The latter commonly includes one or more nozzle rows which can apply, for example, printing ink with specific properties onto the container 110, for example, using a drop-on-demand printing process. Other printing methods can also presently be used. For this, these nozzle rows include several nozzles which can apply the ink with very high accuracy onto the container wall of the container 110. Typical accuracies presently range from a few hundredths of a millimeter up to a few tenths of a millimeter, depending on the purpose. Even coarser accuracies are possible. However, in order to achieve high printing accuracy using the print heads or the print head, respectively, of the print head module 102, accordingly accurate alignment of the print head and hence of the print head module 102 relative to the container 110 is necessary.

This requires, firstly, respectively accurate position measurement of the print head module 102 or the print head, respectively, and, secondly, accurate control of the print head module 102 to adjust its position. For this purpose, the printing unit 120 includes a measuring system 204. This measuring system 204 can be configured in many ways. The position of the printing unit 120 and thereby the position of the print head module 102 relative to the container 110 or the conveyor can be determined, for example, using optical sensors. Similarly, magnetic or capacitive measuring principles can be applied. It can also be provided that the measuring system determines its own position using tracks or similar devices provided for this purpose and compares it to reference data stored in a system memory, presently not illustrated, where an embodiment of the measuring system 204 with magnetic or capacitive measuring devices is presently advantageous over optical ones. This is particularly advantageous where the containers 110 are supplied to the printing machine with very high accuracy. Deviations in the positioning of the print heads of the print head module 102 relative to the container 110 then arise due to misalignments of the print head/s or the print head module 102, respectively. It is intended that a respective control unit 290 can process the data of the measuring system 204 in a suitable manner and that that control device of a movement system being provided in the printing unit 120 positions the print head module 102 accordingly.

Figure 2A:
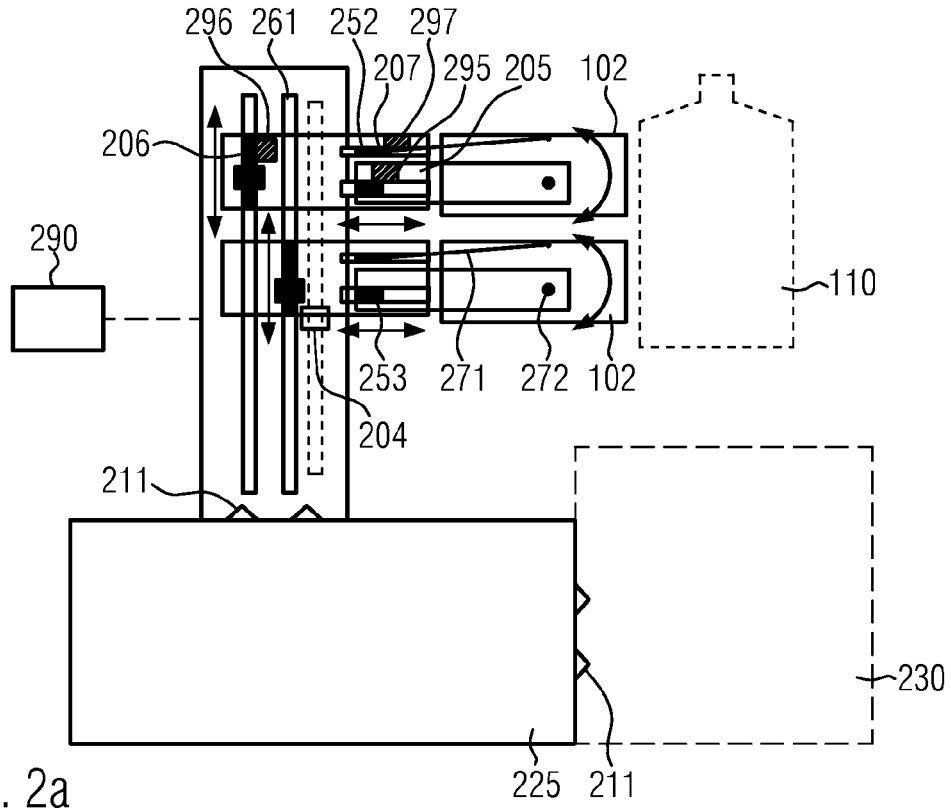
FIG. 2*a* shows a detailed schematic view of a first representation of a printing unit of the printing machine according to the disclosure.

For this, the movement system can include three modules, a radial module 205, a height module 206, and a tilting module 207. The radial module is designed such that it can set a distance of the print head module 102 to the container 110. For this, a horizontally arranged track is provided as shown in FIG. 2*a*. A respective motor 296, for example a motor-spindle-nut drive, can presently adjust the distance of the print head module 102 from the container wall 110 according to the instructions of the control device.

In order to achieve complete and correct printing onto the container 110, the height module 206 can effect height adjustment of a print head module 102. For this, it is likewise preferably equipped with a motor-spindle-nut drive and allows movement of the print head module 102 or a respective extension 262, respectively, along a vertical axis.

The tilting module 207 is similar in construction and advantageously also includes a motor-spindle-nut drive. However, it engages with the print head module 102 such that it can be tilted relative to the outer wall of the container 110. This can be seen in FIG. 2*b*. A print head module 102 is here to be guided along a lateral bevel of a container 110. The required slant of the print head module 102 is achieved by the tilting module 207. For this purpose, it is provided that the tilting module 207 includes a tilt bar 271 or other connection being arranged offset from a pivot point 272 on the print head module 102. By moving the tilt bar 271, a respective rotation of the print head module 102 is effected about the pivot point 272. Other configurations are presently also conceivable.

Since inaccuracies in the positioning of the print head module 102 in relation to the container 110 can occur, in particular due to an unintentional change of position of the print head module 102 caused by continuing operation of the possibly continuously powered motor-spindle-nut drives or more generally of the motors of the individual modules, it is preferable that these modules include clamps 251, 252 and 253 at the respectively moving parts. These clamps allow for fixation of the print head module 102 in the position prescribed by the control unit 290. This is not only advantageous where one of the print head modules 102 has performed the adjustment according to the data specified by the control unit 290 and further motion of this module is no longer required, but especially when, for example, the height module 206 is to perform vertical adjustment of the print head module 102, whereas the tilting module 207 is not to cause any additional tilt.

Preferably, no motion of the print head module 102 occurs during the printing process. Respective motions of the print head module 102 due to at least one of the modules 205, 206, 207 for adjusting the position of each print head module are therefore preferably performed prior to the printing process. Since any motion of the print head module 102, however, can also take place at very high speeds in order to ensure a greater throughput in the printing machine, there are high accelerations that can result in accidental tilting and/or displacement of the print head module 102. The provision of respective clamps 251, 252 and 253 can support fixation of the print head module 102 in terms of either a change in position caused by the radial module 205, a change in position caused by the height module 206, or a change in position caused by the tilting module 207. The clamps can for this purpose be configured, for example, mechanically in the form of break shoes or clamp jaws, but can also be provided electromagnetically.

Furthermore, each printing unit 120 in an advantageous manner includes at least one ink tank 225 associated to it, in which the ink to be applied to the container 110 is stored. In addition, each printing unit 120 advantageously includes at least one device for centering and/or clamping/fixing (for example, a clamping/or centering system like a zero-point clamping element) 211 of the printing unit 120. Since it can be advantageous to have the entire printing unit 120 with the ink tank 225 be exchangeable, it can include a device for centering and/or clamping/fixing 211 to be attached to other stationary machine parts 230 of the printing machine. The devices for centering of the printing unit 120 can there be configured such that they can be attached to the ink tank 225. However, centering the printing unit can be effected directly on further machine parts 230 of the printing machine. It is thereby ensured, even after replacing a respective printing unit 120, that the latter can with very high accuracy again be placed in a predetermined position.

Although presently not shown, it is possible that the nozzle row or the nozzle rows of a print head of a print head module 102 are tilted relative to the direction of transport of the containers 110 to be printed. This is a tilting that can not be compensated by the tilting module 207. The tilting module 207 according to FIG. 2*b* causes tilting of the print head module 102 such that the print head module 102 runs as parallel as possible to the surface of the container 110 to be printed. However, the nozzle rows can be perpendicular thereto, i.e., tilted in the direction of transport of the container to be printed. This misalignment can not be compensated by the tilting module. To compensate for this tilting, an alignment module can additionally be provided which provides for vertical alignment of the nozzle rows of the print head module 102 relative to the direction of transport of the containers 110 to be printed. Adjustment as a whole of the print head module and in particular of the nozzle rows relative to each degree of freedom of movement is thereby possible.

Although the radial module 205, the height module 206, and the tilting module 207 were presently described as being suitable for the changes in position of the print head module 102, respective assemblies can also be provided to separately allow for a change in position of a single print head. It is particularly advantageous if the measuring system 204 can measure the position of the print head module 102 and/or the print head with an accuracy of less than 0.5 mm, preferably of less than 0.1 mm, particularly preferably of less than 0.01 mm, and can forward respective data to the control unit 290 which in turn can perform an adjustment of the position of the print head and/or the print head module 102 with corresponding accuracy.

Figure 2B:
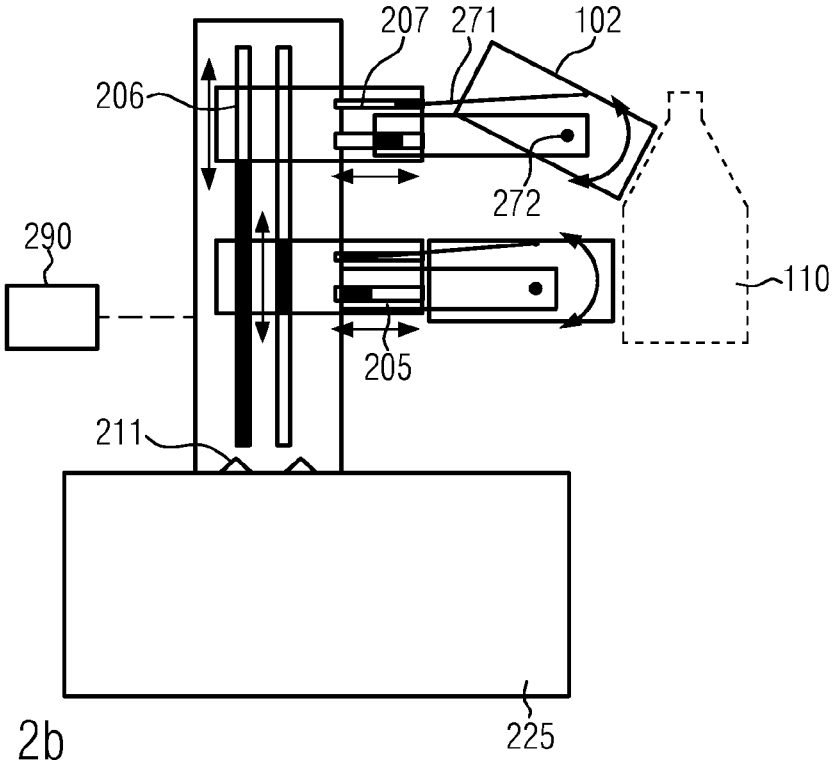
FIG. 2*b* shows a detailed schematic view of a second representation of a printing unit of the printing machine according to the disclosure.
Figure 2C:
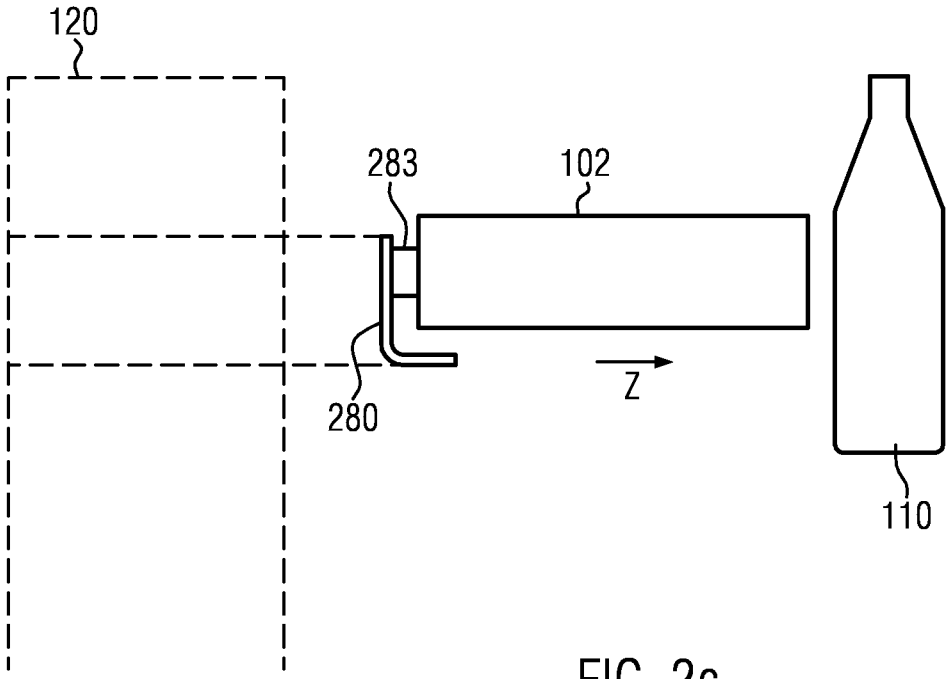
FIG. 2*c* shows a detailed schematic view of a third representation of a printing unit of the printing machine according to the disclosure.
Figure 2D:
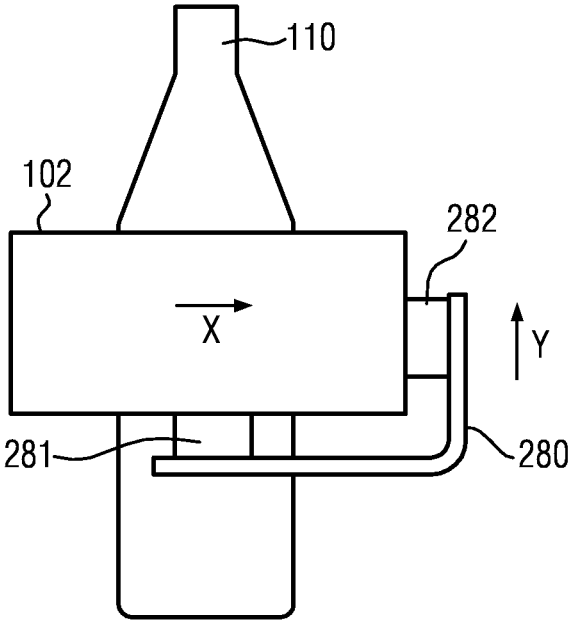
FIG. 2*d* shows a detailed schematic view of a fourth representation of a printing unit of the printing machine according to the disclosure.

The embodiment illustrated in FIGS. 2*a* and 2*b* using the radial module, the height module and the tilting module is basically suitable to achieve positioning of the print head module. However, in order to effect even finer adjustment of the print head position, it can be provided to additionally connect each print head module 102 according to FIG. 2*c* via a support 280 to the printing unit 120. Attachment of the modules described in FIGS. 2*a* and 2*b*, i.e., of the radial module 205, the height module 206 and the tilting module 207 can then be effected on this support 280. The print head module 102 is then attached to this support preferably using piezo-electric elements 281, 282 (as shown in FIG. 2*d*) and 283 (as shown in FIG. 2*c*). With these piezo-electric elements, the print head module 102 can be positioned in the illustrated X-direction and Y-direction according to FIG. 2*c*, as well as the Z-direction according to FIG. 2*d* with a very high accuracy relative to the container 110 to be printed, which in this example defines the Y-axis. This allows, firstly, basically very accurate positioning of the print head module 102 even without releasing the clamps 251, 252 and 253, which is particularly advantageous with necessary positional changes that are significantly less than one millimeter. Furthermore, due to the rapid responsiveness of the piezo-electric elements, use of the piezo-electric elements 281, 282 and 283 allows for fine adjustment of the positioning of the print head modules 102 even during operation of the apparatus.

This fine adjustment can be done in an advantageous manner even for each container to be printed and be achieved, for example, by using sensors that very accurately determine the position of the container or record and evaluate the printed image that was created by the preceding print head module. It can therefore be provided, for example, that each print head module, for example, by using UV ink, applies markings to a container that can be recorded and evaluated by a respectively provided sensor, so that the control unit 290 effects fine adjustment of the subsequent print head module using the piezo-electric elements in dependency of the position of the print image relative to the sensor. Such sensors are preferably each attached between two print head modules 102, as shown for example in FIG. 1, so that fine adjustment of a print head module can be effected respectively in dependency of the information of the position mark which was by the preceding print head module applied onto the container to be printed.

It is presently to be mentioned in the context of the configuration of the fine adjustment that when using linear machines, positioning or fine adjustment, respectively, using a piezo-electric element in the Z-direction, as shown in FIG. 2*c*, can be dispensed with provided that the containers to be printed are transported by the linear conveyor within the linear conveyor with sufficiently accurate positioning in relation to the Z-direction.

Figure 3:
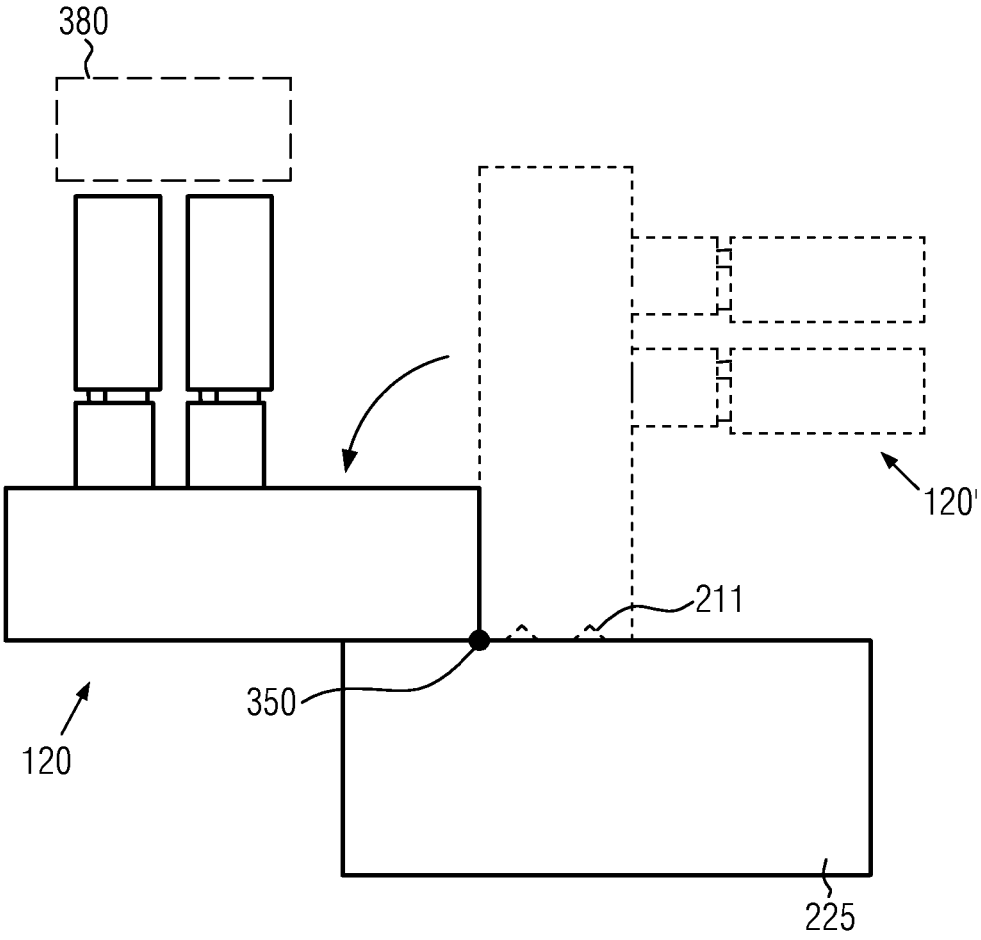
FIG. 3 shows a possible exchange process of a printing unit.

FIG. 3 shows a possible embodiment of the exchange or the removal of a printing unit 120. For enabling this, it can be provided that, in addition to the centerings 211 described in FIG. 2, a swivel axle 350 is provided that enables the printing unit 120' to be rotated away from its initial position (shown here in dashed lines) to a transport position which is given by the printing unit 120. The printing unit 120 to be exchanged can then be removed by separating it from the swivel axle 350. Fast and flexible removal of a printing unit 120 is thereby possible. To install a new printing unit 120, the same procedure is performed in reverse order. The printing unit 120 is brought into the position illustrated and is connected to the swivel axle 350. It is then guided by the swivel axle 350, rotated to the centering device 211, and thereby connected to the printing machine at a particular location. The transport position additionally enables certain accessibility and possible replacement/removal/servicing of specific individual parts of the printing unit 120.

In addition to the above-described alignment of the print head modules 102 using the radial module 205, the height module 206, and the tilting module 207, further motions can also be provided, for example, for servicing the print head module 102 or for protecting the nozzle rows for cleaning purposes. The modules 205, 206, 207 can be used, for example, to move a print head module 102 into a protective position when it is not used. For this, the print head module can, for example, be tilted by 90° and moved in a radial direction away from the containers, so that it can no longer be used for printing onto the containers and to prevent damage to the nozzle rows in the protective position by accidental contact with containers and to prevent the nozzle rows, and especially the ink from drying out or from foreign particles such as dust. For this purpose, it is particularly advantageous to have the protective position be provided in an area shielded from light. Furthermore, it is advantageous to have the nozzle rows pointing towards the ground, so that any ink drops can drip off and thereby not lead to any impairment of the nozzle rows. There can also be (automatic) cleaning of the print head module 102 and in particular of the nozzle rows can in a respective position or any other position. It can presently be advantageously provided that a cleaning unit 380 commences automatic cleaning of the nozzle rows and/or the print head module 102 once the print head module 102 is in the respective position. This provides a significant advantage over removing the print head module for cleaning purposes since no cleaning needs to be performed outside the printing machine (100), nor is any new adjustment of the position of the print head module 102 required after replacement. Servicing the print head module can also be performed in such a position. When servicing is performed automatically, the servicing position can be identical to the protective position. If it is performed manually, it can be advantageous for the servicing position to be provided at a location well accessible for an operator of the machine.

The invention claimed is:

1. A printing machine for printing onto containers comprising at least one conveyor and at least one printing unit with a print head module, with at least one print head, each print head comprising one or more nozzle rows, a movement system for adjusting the position of said print head module, a measuring system for determining the position of said print head module and a control unit for controlling said movement system, and the movement system comprising a radial module for adjusting the position of said print head module in the radial direction, and a height module for adjusting the height of said print head module in the vertical direction and the movement system further comprises an alignment module for vertical alignment of the one or more nozzle rows of said print head relative to the direction of transport of said containers to be printed.

2. The printing machine according to claim 1, and a tilting module for adjusting the tilting of said print head module.

3. The printing machine according to claim 2, and in said radial module, said height module and said tilting module are adjustable independently of each other.

4. The printing machine according to claim 2, and in said radial module, said height module and said tilting module each comprise a motor.

5. The printing machine according to claim 1, and said printing unit comprises a device for centering said printing unit.

6. The printing machine according to claim 1, and said measuring system can measure the position of said print head module.

7. The printing machine according to claim 1, and said print head modules are provided exchangeably.

8. The printing machine according to one claim 1, and said control unit adapted to adjust the position of said print head module.

9. The printing machine according to claim 1, further comprising a line, and said printing unit is associated via the line to an ink tank connected to it.

10. The printing machine according to claim 1, and said control unit being adapted to adjust the position of said print head module in dependency of data that is transmitted from said measuring system to said control unit.

11. The printing machine according to claim 2, and said radial module, said height module, and said tilting module comprise clamps adapted to fix said radial module, said height module and said tilting module in a position.

12. The printing machine according to claim 1, and piezoelectric elements are provided associated to a print head module and are adapted to align said print head module relative to said containers to be printed.

13. The printing machine according to claim 1, and a protective position and/or a cleaning position and/or a servicing position are provided into which said print head module is movable.

14. The printing machine according to claim 13, and a cleaning unit is provided for cleaning said print head module when said print head module is located in said cleaning position.

15. The printing machine according to claim 1, and the containers comprise bottles.

16. The printing machine according to claim 4, and the motor or comprises a motor-spindle nut drive.

17. The printing machine according to claim 6, wherein the measurement system measures the position of the print head module relative to the container with an accuracy of less than 0.1 mm.

18. The printing machine according to claim 6, wherein the measurement system measures the position of the print head module relative to the container with an accuracy of less than 0.01 mm.

19. The printing machine according to claim 8, wherein the control unit processes data from the measurement system and adjusts the position of the print head module relative to the container with an accuracy of 0.1 mm.

20. The printing machine according to claim 8, wherein the control unit processes data from the measurement system and adjusts the position of the print head module relative to the container with an accuracy of 0.01 mm.

* * * * *